US012144476B2

(12) United States Patent
Orin

(10) Patent No.: US 12,144,476 B2
(45) Date of Patent: Nov. 19, 2024

(54) GREASE SQUEEGEE

(71) Applicant: Michael Orin, Alamosa, CO (US)

(72) Inventor: Michael Orin, Alamosa, CO (US)

( * ) Notice: Subject to any disclaimer, the term of this patent is extended or adjusted under 35 U.S.C. 154(b) by 63 days.

(21) Appl. No.: 18/096,693

(22) Filed: Jan. 13, 2023

(65) Prior Publication Data

US 2024/0237872 A1 Jul. 18, 2024

(51) Int. Cl.
*A47L 13/03* (2006.01)

(52) U.S. Cl.
CPC ..... *A47L 13/03* (2013.01)

(58) Field of Classification Search
CPC ..... A47L 13/02; A47L 13/022; A47L 13/03
USPC ..... 15/236.01, 236.02
See application file for complete search history.

(56) References Cited

U.S. PATENT DOCUMENTS 7,603,780 B2 * 10/2009 Oikarinen ..... B25G 1/06 30/340
2010/0306947 A1 * 12/2010 White ..... A47L 1/06 15/236.02
2011/0185522 A1 * 8/2011 Parks ..... A47L 13/022 15/111

FOREIGN PATENT DOCUMENTS

GB 2509067 A * 6/2014 ..... A47L 1/08

* cited by examiner

*Primary Examiner* — Randall E Chin
(74) *Attorney, Agent, or Firm* — Lyman Moulton, Esq.; Moulton Patents, PLLC.

(57) ABSTRACT

The Grease Getter is the only product of its kind that utilizes a cardboard blade that can be disposed of and can be used by any company or service that performs or provides lubrication of machines and vehicles as a go-to accessory for post-work clean-up. This unprecedented product is uniquely designed with durable, high-quality materials to ensure long-term sustainability and can be used on any surface to address oil spills and stains, in private or commercial settings.

14 Claims, 2 Drawing Sheets

GREASE SQUEEGEE

BACKGROUND

The management of oil and grease, after vehicle repair and/or restoration, can create nightmare stains that tarnish the floor of a professional site. Typically, cleaning such spills requires immediate care, an excessive amount of scrubbing/physical labor and often individuals will need to spend countless hours using rags in an attempt to remove all the grease. There have been no products available as original equipment or as an aftermarket to address this problem.

An apparatus to simplify and improve the ability to clean up oil and grease, easing the labor required to do so, is not being met by any known device or system at present. There have been no products available as original equipment or as an aftermarket to address this problem either.

SUMMARY OF THE INVENTION

The main purpose of the grease squeegee is to provide users with a tool that effectively scrapes remaining automotive grease off of a garage floor post lubrication of automotive chassis and suspension services.

Figure 1:
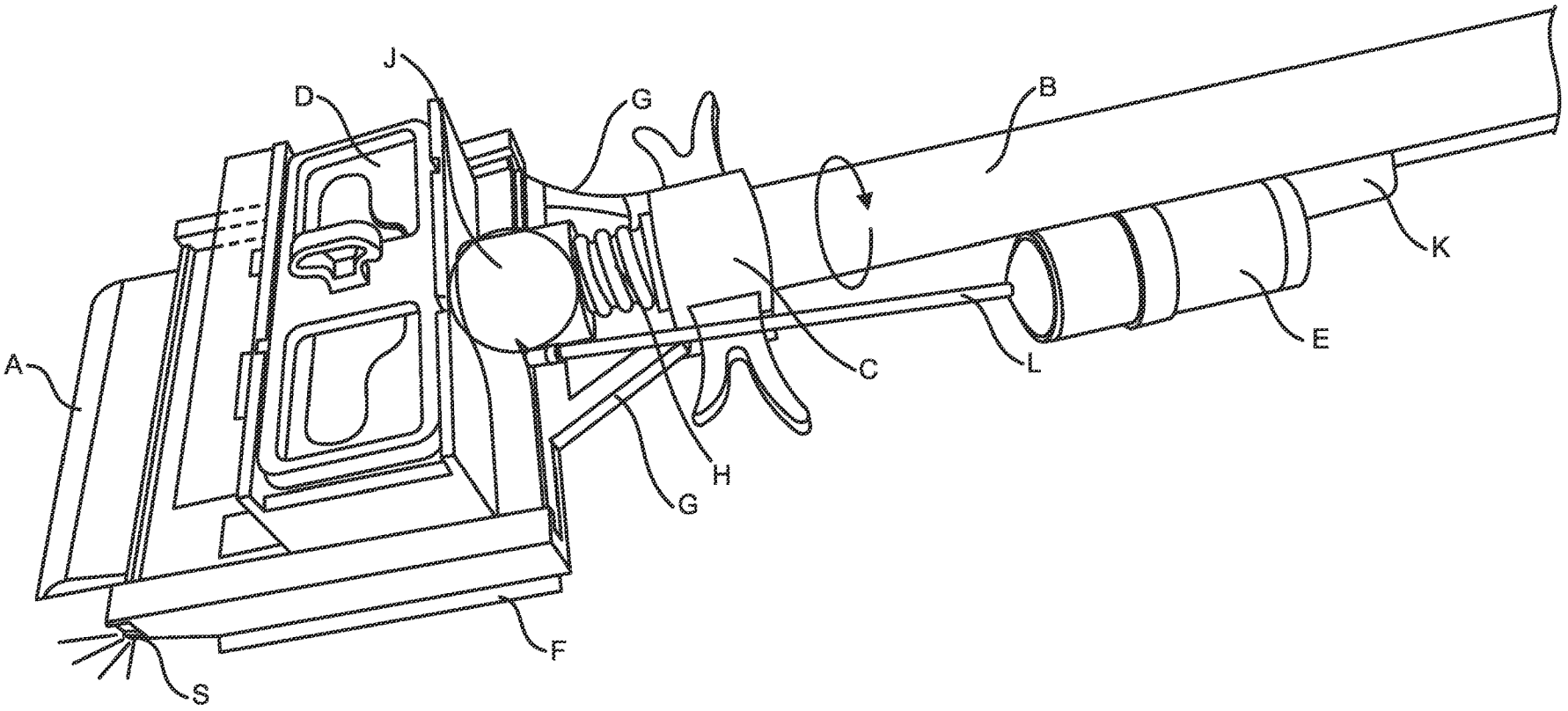
FIG. 1 is a top perspective view of the grease squeegee in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a is a top perspective view of the grease squeegee showing: cardboard grease scraping card with locating and fixing holes referenced as A, long bar with grip handle and screw auger threads referenced as B, buttressed kick attachment referenced as C, scraping card magazine referenced as D, aerosol spray cleaner referenced as E, disposable cleaning pad referenced as F, buttress for kick attachment G, screw auger threads H, an universal ball joint J, an aerosol spray cleaner actuator K, aerosol spray supply line L, and linear spray array S in accordance with an embodiment of the present disclosure.

Figure 2:
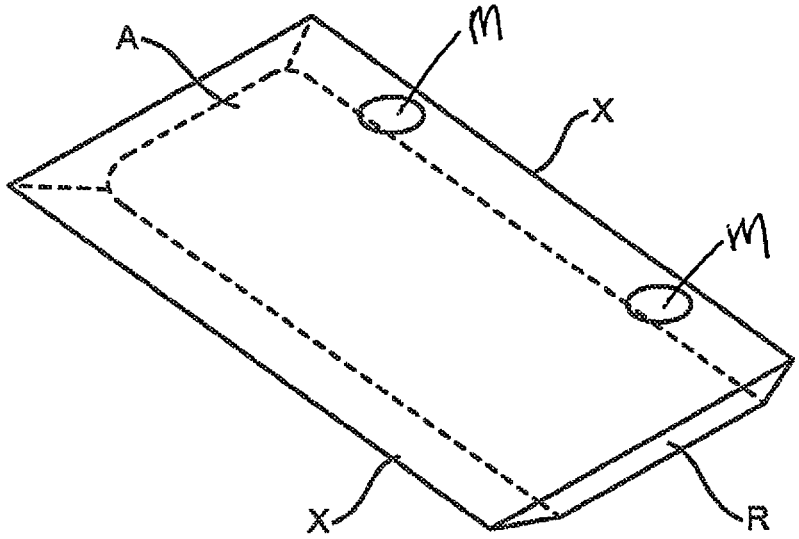
FIG. 2 is a top elevational view of the grease squeegee's cardboard grease scraping card in accordance with an embodiment of the present disclosure.

FIG. 2 is a top elevational view of the grease squeegee's cardboard grease scraping card A showing the cardboard grease scraping card with locating and fixing holes in accordance with an embodiment of the present disclosure. Locating and fixing holes M are shown on the scraping card A. The reinforced chamfer R gives rigidity to the blade edges X which scrape grease and hardened substances from a flooring.

The present disclosed grease squeegee, also known as "Grease Getter", offers a modern accessory that ensures users are able to quickly, effectively, and effortlessly remove grease and oil spills without excessive physical labor. Expanding on the initial design of a long bar with a handle, the Grease Getter introduces a novel disposable cardboard blade that allows its users to completely scrape grease remains off of the floor from a standing position instead of wiping it off with a rag. The cardboard grease scraping card conveniently attaches to the long bar and can be easily switched out and disposed of once the operation is complete. With the Grease Getter, users will no longer have to waste precious time trying to hopelessly remove grease residue with a traditional rag. This innovative, top-quality product will benefit all individuals who seek to have a more effective means of cleaning excess grease and oil off of floors, garages and/or other surfaces.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A cleaning tool comprising:

a grease scraping card having a scraping edge, a width, a length, a bottom side, a top side and a thickness;

a long bar handle in an attachment with the grease scraping card;

an aerosol can bracket attached to the long bar handle and configured to receive an aerosol spray cleaner;

an actuator in a communication with a grip end of the long bar handle and the aerosol can bracket;

a supply line configured to convey the aerosol spray cleaner to the scraping edge; and a magazine attached to the long bar handle and configured to hold a plurality of the grease scraping cards.

2. The cleaning tool of claim 1, wherein the long bar handle comprises a screw auger threaded end configured to attach the long bar handle to the grease scraping card.

3. The cleaning tool of claim 1, further comprising a kick attachment attachable to the long bar handle.

4. The cleaning tool of claim 1, further comprising buttress wings attached to the long bar handle configured to support the attachment to the grease scraping card.

5. The cleaning tool of claim 1, further comprising a linear spray array configured to disperse the aerosol spray cleaner across the scraping edge and the width of the grease scraping card.

6. The cleaning tool of claim 1, wherein the grease scraping card defines a plurality of locating and fixing holes therein.

7. The cleaning tool of claim 1, wherein the grease scraping card thickness comprises the scraping edge along a front width and a back width and an increased thickness there between.

8. The cleaning tool of claim 1, further comprising a disposable cleaning pad attached to the bottom side of the grease scraping card.

9. The cleaning tool of claim 1, wherein the actuator is configured to activate the aerosol spray cleaner in response to a hand action of an operator on the grip end of the long bar handle.

10. The cleaning tool of claim 1, wherein the grease scraping card comprises a hard rubber blade edge.

11. The cleaning tool of claim 1, wherein the aerosol can bracket is configured to receive an aerosol spray cleaner chemically formulated to break down automobile grease.

12. The cleaning tool of claim 1, wherein the supply line conveys the aerosol spray cleaner to the scraping edge assisted by a gravity weight on the aerosol cleaner.

13. The cleaning tool of claim 1, wherein the supply line conveys the aerosol spray cleaner to the scraping edge via a pressure in the aerosol spray can.

14. The cleaning tool of claim 1, wherein a relation between the long bar handle and the scraping edge is variable via a universal ball joint there between.

* * * * *